US009632445B2

(12) United States Patent
Watanabe et al.

(10) Patent No.: US 9,632,445 B2
(45) Date of Patent: Apr. 25, 2017

(54) IMAGE FORMING APPARATUS

(71) Applicant: KYOCERA Document Solutions Inc., Osaka (JP)

(72) Inventors: Toshihiko Watanabe, Osaka (JP); Hirofumi Kuroki, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/045,939

(22) Filed: Feb. 17, 2016

(65) Prior Publication Data

US 2016/0246232 A1 Aug. 25, 2016

(30) Foreign Application Priority Data

Feb. 24, 2015 (JP) ..... 2015-034471

(51) Int. Cl.

| | |
|---|---|
| ***G03G 15/00*** | (2006.01) |
| ***G03G 15/01*** | (2006.01) |
| ***G03G 21/16*** | (2006.01) |

(52) U.S. Cl.

CPC ..... *G03G 15/0142* (2013.01); *G03G 15/5016* (2013.01); *G03G 21/1604* (2013.01); *G03G 15/5075* (2013.01); *G03G 15/5087* (2013.01); *G03G 21/1609* (2013.01)

(58) Field of Classification Search

None

See application file for complete search history.

(56) References Cited

U.S. PATENT DOCUMENTS

| | | | | |
|---|---|---|---|---|
| 6,181,884 | B1 * | 1/2001 | Isogai | H04N 1/00567 358/296 |
| 2006/0018692 | A1 * | 1/2006 | Kubo | G03G 15/6552 399/405 |
| 2009/0002954 | A1 * | 1/2009 | Huber | G03G 15/5016 361/728 |
| 2009/0074491 | A1 * | 3/2009 | Morohoshi | G03G 15/00 399/388 |
| 2010/0214585 | A1 * | 8/2010 | Tanji | G03G 15/6552 358/1.12 |

(Continued)

FOREIGN PATENT DOCUMENTS

| | | | |
|---|---|---|---|
| JP | H11314826 | A | 11/1999 |
| JP | 2001-066946 | A | 3/2001 |
| JP | 2009260904 | A | 11/2009 |

OTHER PUBLICATIONS

Notice of Reasons for Refusal mailed by Japan Patent Office on Aug. 17, 2016 in the corresponding Japanese patent application No. 2015-034471.

*Primary Examiner* — David M Gray
*Assistant Examiner* — Thomas Giampaolo, II
(74) *Attorney, Agent, or Firm* — IP Business Solutions, LLC

(57) ABSTRACT

An image forming apparatus includes an image forming unit that forms an image on a recording sheet. A casing constituting an outer shell of the image forming apparatus is formed in a table shape including a top plate and a leg portion supporting the top plate, the top plate including a flat working surface. The image forming unit is located inside the top plate. The top plate includes a recording sheet outlet from which the recording sheet having an image formed thereon is discharged.

13 Claims, 8 Drawing Sheets

(56) References Cited

U.S. PATENT DOCUMENTS

| | | | | |
|---|---|---|---|---|
| 2010/0241543 | A1* | 9/2010 | Matsumoto | G03G 21/02 705/34 |
| 2012/0163857 | A1* | 6/2012 | Kamimura | G03G 21/1633 399/110 |
| 2013/0258367 | A1* | 10/2013 | Saito | G06K 15/14 358/1.9 |

* cited by examiner

IMAGE FORMING APPARATUS

INCORPORATION BY REFERENCE

This application claims priority to Japanese Patent Application No.2015-034471 filed on Feb. 24, 2015, the entire disclosure of which is incorporated herein by reference.

BACKGROUND

The present disclosure relates to an image forming apparatus that forms an image on a recording sheet.

Image forming apparatuses have been known that form an image on a recording sheet on the basis of image data outputted from an external device such as a personal computer (PC). The image forming apparatuses are installed not only in offices and at home, but also in commercial facilities such as a convenience store. By utilizing such an image forming apparatus, a user can output the image data outside the home.

SUMMARY

The disclosure proposes further improvement of the foregoing technique.

In an aspect, the disclosure provides an image forming apparatus including an image forming unit configured to form an image on a recording sheet.

A casing constituting an outer shell of the image forming apparatus is formed in a table shape including a top plate and a leg portion supporting the top plate, the top plate including a flat working surface.

The image forming unit is located inside the top plate.

The top plate includes a recording sheet outlet from which the recording sheet having an image formed thereon is discharged.

DETAILED DESCRIPTION

To start with, the idea from which the present inventors have conceived the image forming apparatus according to the disclosure will be described.

In recent years, so-called nomad workers, who work with a notebook computer or a tablet terminal on a table of a coffee shop or a fast food shop, instead of in the office or at home, have been increasing. It is natural that such nomad workers wish to output the generated or edited image data in the shop, and therefore some coffee shops and fast food shops provide an exclusive space inside the shop, to install an image forming apparatus in the exclusive space.

However, the user has to move from his/her seat to the exclusive space where the image forming apparatus is installed, to pick up the outputted recording sheet. Therefore, the notebook computer or the tablet terminal placed on the table may be stolen, or the screen of the notebook computer or the tablet terminal may be spied, while the user is away for retrieving the recording sheet. In addition, the recording sheet outputted from the image forming apparatus may be stolen.

Since the coffee shops and fast food shops are accessible by general public, information that the user is handling may leak to an unspecified person as stated above. Under such situation, the user is unable to utilize the image forming apparatus without worry, despite the image forming apparatus being available in the shop.

In addition, from the viewpoint of the shop who wishes to secure as many seats as possible in the limited shop space, it is not desirable to spare the exclusive space only for the nomad workers who utilize the image forming means. Further, the image forming apparatuses are generally designed for use in an office or at home, and therefore installing the image forming apparatus may impair the atmosphere of the coffee shop or fast food shop.

The disclosure provides an image forming apparatus in view of the foregoing situation, to enable the image forming means to be installed in a facility accessible by general public, such as a coffee shop or fast food shop, without providing an exclusive space, and to enable the user to utilize the image forming means free from the risk of information leakage.

Hereafter, the image forming apparatus according to the disclosure, conceived by the present inventors, will be described with reference to the drawings.

Figure 1A:
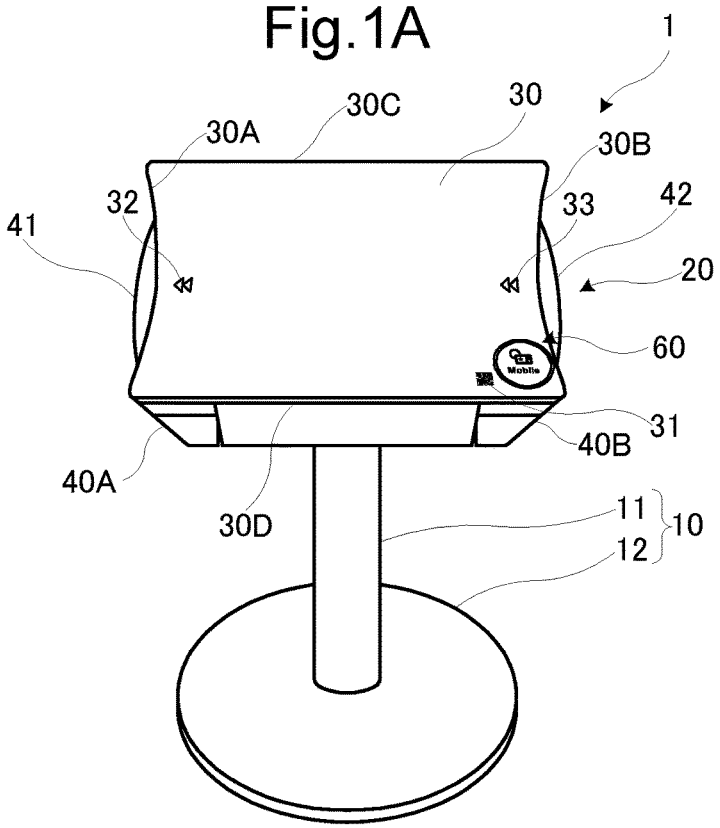
FIG. 1A, FIG. 1B, and FIG. 1C are a perspective view, a top view, and a side view respectively, showing an appearance of an image forming apparatus according to an embodiment of the disclosure.
Figure 1B:
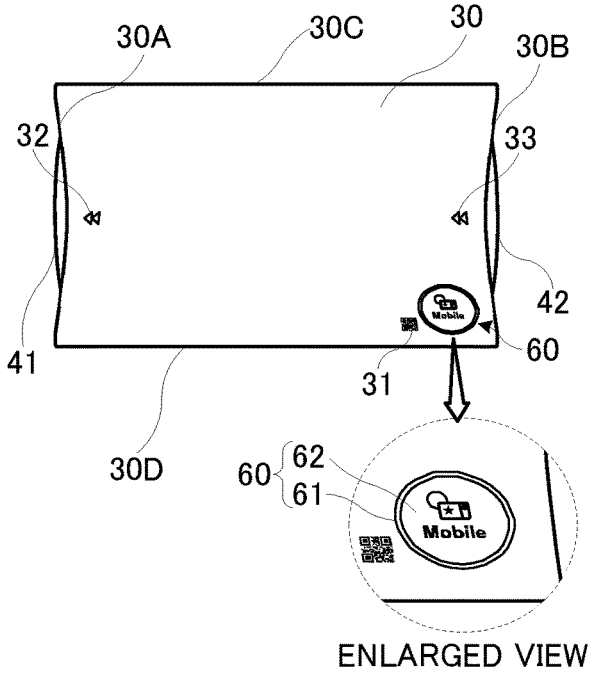
Figure 1C:
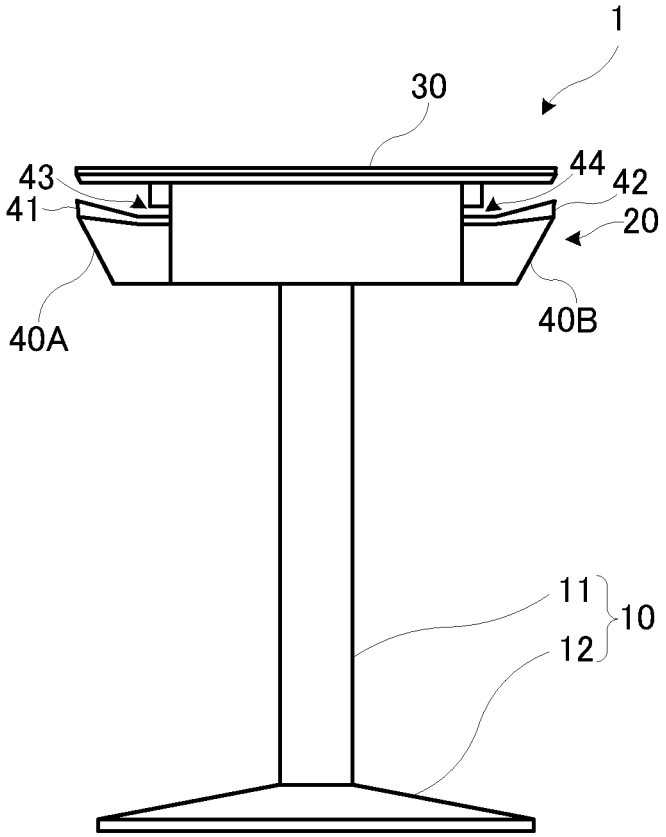

First, the appearance of the image forming apparatus 1 will be described. FIG. 1A to FIG. 1C illustrate the appearance of the image forming apparatus according to an embodiment of the disclosure, FIG. 1A being a perspective view, FIG. 1B being a top view, and FIG. 1C being a side view of the image forming apparatus.

The image forming apparatus 1 is a multifunction peripheral having a plurality of functions, such as copying, printing, and scanning. As shown in FIG. 1A to FIG. 1C, the image forming apparatus 1 includes a casing constituting the outer shell of the image forming apparatus 1, the casing being formed in a table-like shape including a top plate 20 and a leg portion 10 supporting the top plate 20.

The leg portion 10 includes a generally circular pedestal 12 placed on an installation surface such as a floor surface, and a generally column-shaped support column 11 erected on the pedestal 12. The support column 11 fixed to the bottom face of the top plate 20, so as to retain the top plate 20 at a predetermined height.

The top plate 20 is generally plate-shaped, and includes therein an image forming unit 51 and an image reading unit 52 (see FIG. 2) to be subsequently described. A recording sheet outlet 43 is provided on a side face 40A of the top plate 20, for discharging a recording sheet on which an image has been formed by the image forming unit 51 located inside the top plate 20. A discharge guide member 41 having a flat plate shape is provided under the recording sheet outlet 43, so as to outwardly extend from the side face 40A. The discharge guide member 41 is inclined toward the top face 30 in an outward direction, so as to guide the recording sheet discharged from the recording sheet outlet 43 obliquely upward. Such a configuration facilitates the user to pick up the recording sheet discharged from the recording sheet outlet 43, from an upper position.

On a side face 40B of the top plate 20, opposite to the side face 40A, a document inlet 44 is provided for inserting a source document to be read by the image reading unit 52 provided inside the top plate 20. An insertion guide member 42 having a flat plate shape is provided under the document inlet 44, so as to outwardly extend from the side face 40B. The insertion guide member 42 is inclined toward the top face 30 in an outward direction, so as to guide the source document inserted by the user from an upper position, to the document inlet 44.

A top face 30 of the top plate 20 is generally flat, and serves as working surface on which a notebook computer or a tablet terminal is to be placed. Out of four sides 30A, 30B, 30C, and 30D defining the top face 30 of the top plate 20, the left side 30A has a generally arcuate shape such that a central portion is recessed inwardly (to the right) with respect to end portions. Accordingly, an outer end portion of the discharge guide member 41 opposite to the recording sheet outlet 43 can be visually recognized in a view from above. Such a configuration facilitates the user to confirm the recording sheet discharged from the recording sheet outlet 43. In addition, the right side 30B opposite to the left side 30A also has a generally arcuate shape such that a central portion is recessed inwardly (to the left) with respect to end portions. Accordingly, an outer end portion of the insertion guide member 42 opposite to the document inlet 44 can be visually recognized in a view from above, and therefore the user can easily identify the insertion position of the source document.

A pattern image such as a QR code (registered trademark) 31 is provided on the top face 30 of the top plate 20. The user can make access to a site of a predetermined uniform resource locator (URL), by reading the QR code 31 with an electronic device such as a smartphone. On the accessed site, for example manual information indicating how to use the image forming apparatus 1 can be viewed.

A light emitter 32 is provided in a left end portion of the top face 30 of the top plate 20, and a light emitter 33 is provided in a right end portion. The light emitter 32 and the light emitter 33 each include a light source such as a light emitting diode (LED), and emit light under the control of an operation control unit 102 to be subsequently described, in association with the image forming operation by the image forming unit 51 and the image reading operation by the image reading unit 52.

Further, a card reader 60 is provided on the top face 30 of the top plate 20. The card reader 60 includes a reading unit 62 that reads identification information proper to the user, from an object to be read located nearby. The reading unit 62 may be, for example, a near field communication (NFC) reader. When the object to be read such as a member card carrying an NFC tag is brought closely opposite the NFC reader, power is supplied to an antenna coil provided in the NFC tag, by electromagnetic induction. Utilizing the power thus supplied, the antenna coil transmits the identification information stored in a built-in memory in the NFC tag. The NFC reader reads the identification information from the object to be read located close thereto, upon receipt of the identification information transmitted as above.

The card reader 60 further includes a light emitter 61 formed so as to surround the reading unit 62. The light emitter 61 includes a light source such as an LED, and emits light under the control of the operation control unit 102 in association with the reading operation by the reading unit 62.

Figure 2:
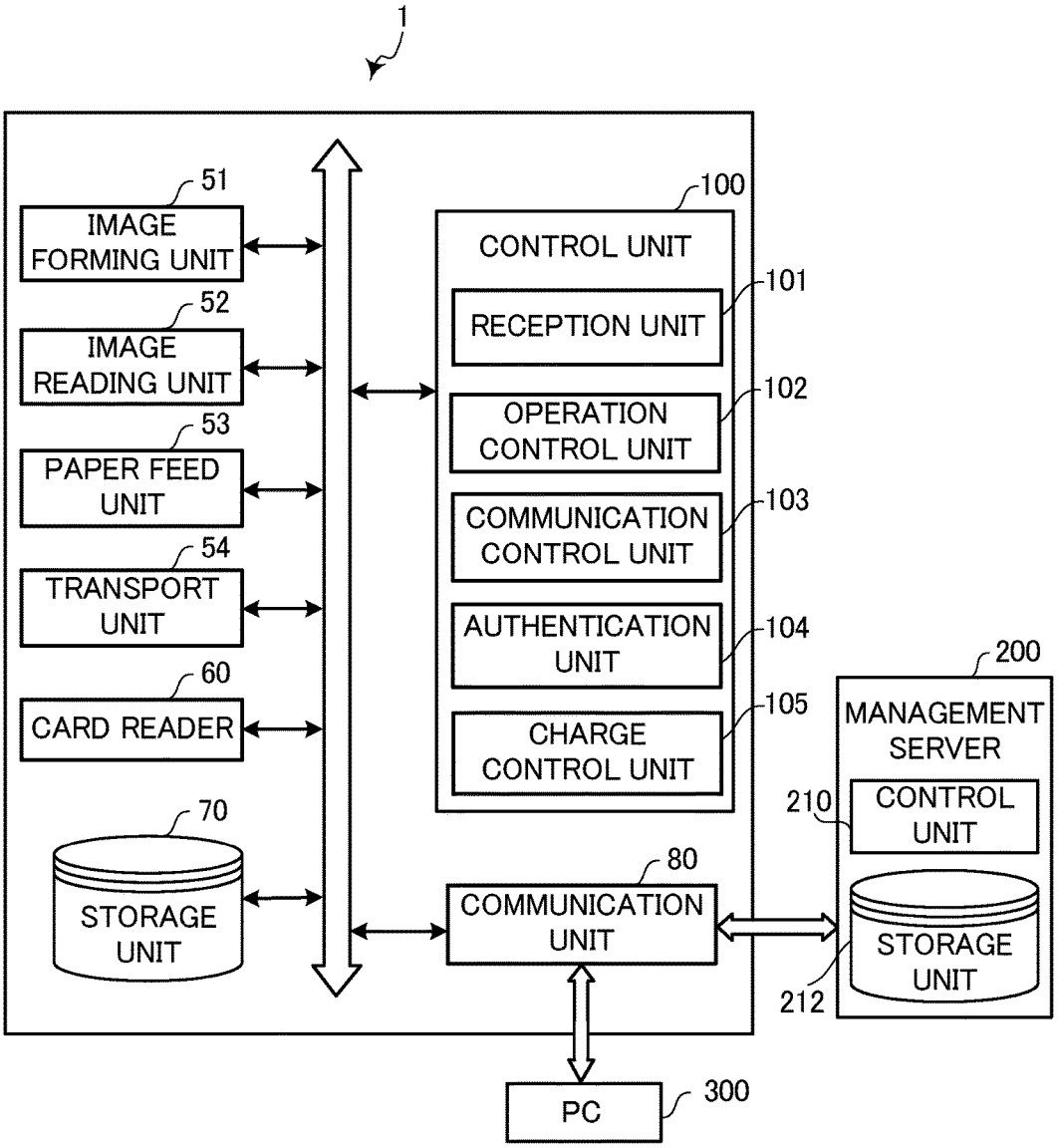
FIG. 2 is a block diagram showing an internal configuration of the image forming apparatus according to the embodiment of the disclosure.

An internal configuration of the image forming apparatus 1 will now by described hereunder. FIG. 2 is a block diagram showing the internal configuration of the image forming apparatus 1 according to the embodiment of the disclosure. The description of the constituents already referred to above may be simplified or omitted.

A paper feed unit 53 includes a non-illustrated pickup roller, to transport (feed), with the pickup roller, the recording sheet placed in a paper feed cassette 541 (see FIG. 5A) to be subsequently described, toward a recording sheet transport route arranged inside the top plate 20.

A transport unit 54 includes a plurality of non-illustrated transport roller pairs respectively located at a plurality of positions on the recording sheet transport route in the top plate 20, to transport the recording sheet along the recording sheet transport route with the transport roller pairs.

The image forming unit 51 is installed at a predetermined position on the recording sheet transport route in the top plate 20. The image forming unit 51 includes, though not illustrated, a photoconductor drum, a charging device, an exposure device, a developing device, and so forth, and forms an image on the recording sheet supplied from the paper feed unit 53 on the basis of the image data outputted from an external device such as a PC 300, through a charging, exposing, and developing process. The recording sheet on which the image has been formed by the image forming unit 51 is transported by the transport unit 54 and discharged through the recording sheet outlet 43.

The image reading unit 52 is a scanner including a non-illustrated light emitting device such as an LED and a non-illustrated light receiving device such as a complementary metal oxide semiconductor (CMOS) image sensor. The image reading unit 52 is installed at a predetermined position on the recording sheet transport route in the top plate 20, and optically reads the source document inserted through the document inlet 44 and transported by the transport unit 54. The image data generated by the image reading unit 52 is subjected to various types of image processing such as shading correction, gamma correction, chromatic aberration correction, modulation transfer function (MTF) correction, and scanner color correction, and then stored in a storage unit 70.

The storage unit 70 is a large-capacity storage device such as a hard disk drive (HDD).

A communication unit 80 is a communication interface including a communication module such as a LAN chip. The communication unit 80 is connected to the external device such as the PC 300 and a management server 200 to be subsequently described, via a network connected by wire or wirelessly.

The image forming apparatus 1 further includes a control unit 100. The control unit 100 includes a central processing unit (CPU), a random access memory (RAM), a read only memory (ROM), and so forth. The control unit 100 act as reception unit 101, operation control unit 102, communication control unit 103, authentication unit 104, and charge control unit 105, by causing the CPU to execute a corresponding control program stored in the ROM or the storage unit 70. However, the reception unit 101, the operation control unit 102, the communication control unit 103, the authentication unit 104, and the charge control unit 105 of the control unit 100 may be constituted of a hardware circuit, instead of the operation based on the control program.

The communication control unit 103 is configured to transmit and receive data to and from the external device such as the PC 300 and the management server 200, through the communication unit 80.

The reception unit 101 is configured to receive an instruction regarding image formation (image forming instruction) and an instruction regarding image reading (image reading instruction), received from the external device such as the PC 300 under the control of the communication control unit 103.

The operation control unit 102 (control unit) is configured to control the image forming operation performed by the image forming unit 51 and the image reading operation performed by the image reading unit 52.

The authentication unit 104 is configured to perform user authentication, using the identification information read by the reading unit 62 of the card reader 60.

Here, a plurality of pieces of identification information are stored in advance in a storage unit 212 of the management server 200. The authentication unit 104 causes the communication control unit 103 to receive the plurality of pieces of identification information stored in the storage unit 212, from the management server 200. Then the authentication unit 104 decides whether any of the received identification information agrees with the identification information read by the reading unit 62, to perform the user authentication.

The charge control unit 105 (control unit) is configured to generate charging information according to details of the image forming job or image reading job, such as the number of recording sheets on which an image has been formed or the number of source documents that have been read, when the image forming unit 51 forms an image on the recording sheet or when the image reading unit 52 reads a source document. The charge control unit 105 causes the communication control unit 103 to transmit the generated charging information to the management server 200 together with the identification information read by the reading unit 62 of the card reader 60. A control unit 210 of the management server 200 stores the charging information transmitted from the image forming apparatus 1 in the storage unit 212, in association with the identification information.

Figure 3:
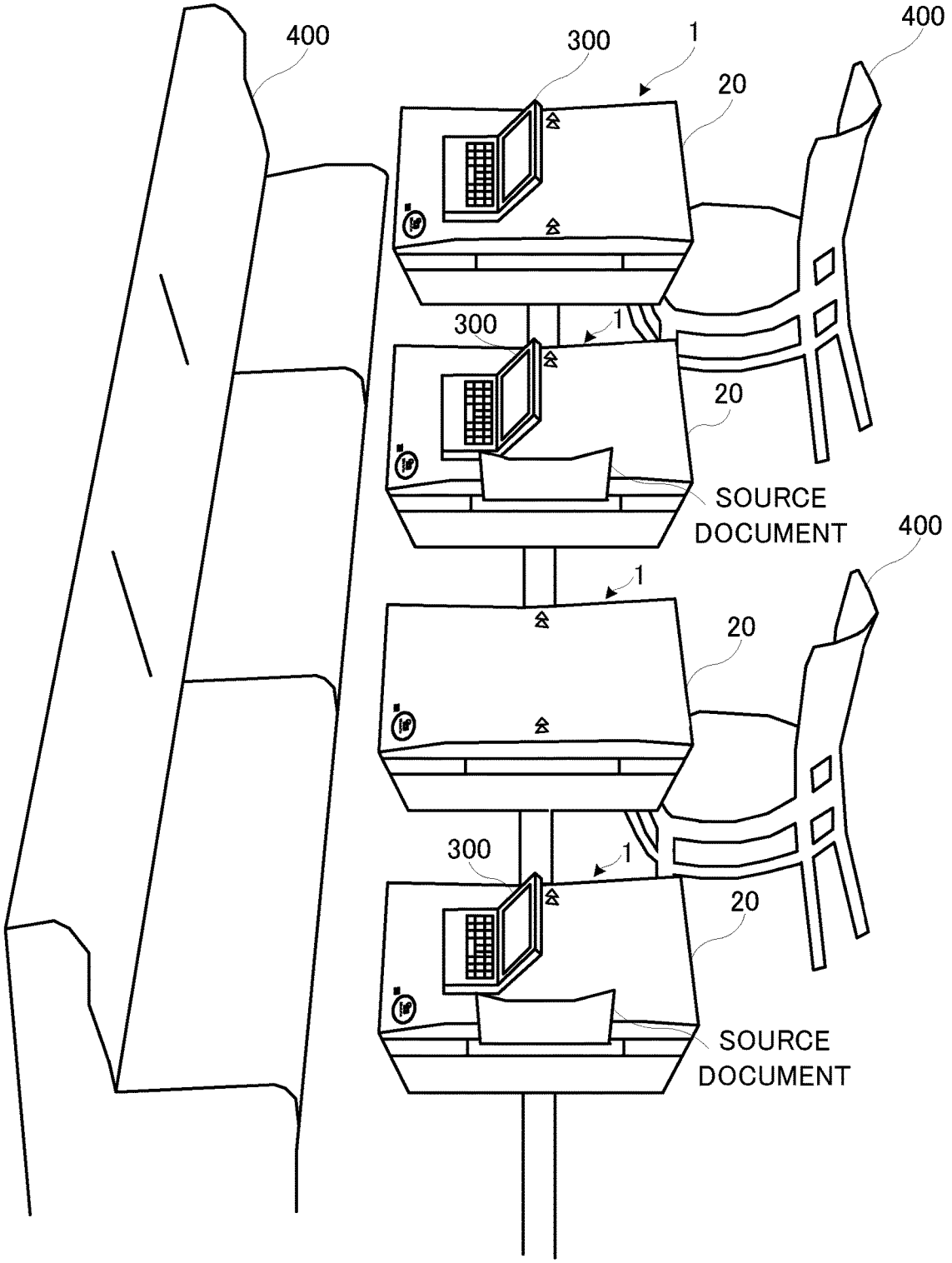
FIG. 3 is a perspective view showing an installation location of the image forming apparatus according to the embodiment of the disclosure.

Hereunder, a mode of use of the image forming apparatus 1 will be described. FIG. 3 is a perspective view showing an installation location of the image forming apparatus 1 according to the embodiment of the disclosure. The image forming apparatus 1 is installed in a facility where a plurality of tables and chairs (seats) are provided, such as a coffee shop or fast food shop. The image forming apparatus 1 has a table-like shape, and the top face 30 of the top plate 20 serves as working surface, on which an electronic device such as a notebook computer and a tablet terminal, and the recording sheets can be placed so as to do a work. Therefore, by substituting some of the existing tables in the coffee shop or fast food shop with the image forming apparatus 1, the image forming means and the image reading means can be offered to the users (customers) such as nomad workers, without reducing the number of seats in the shop. In addition, since the image forming apparatus 1 has a table-like shape, the atmosphere in the coffee shop or fast food shop can be prevented from being impaired, despite the image forming apparatus 1 being installed in the shop.

Figure 4:
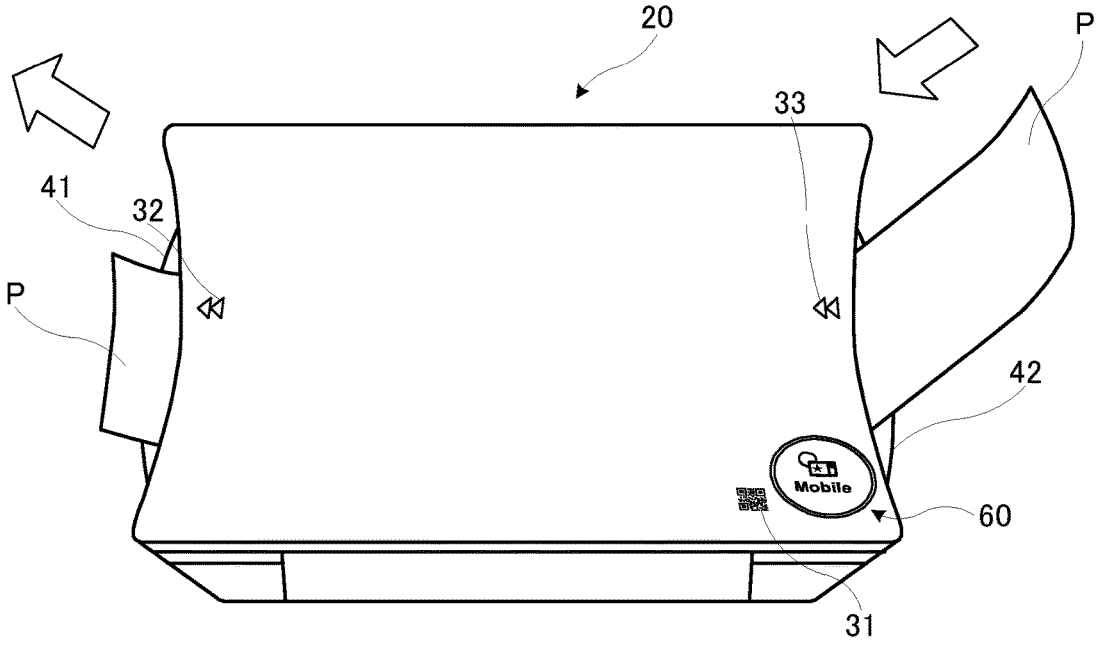
FIG. 4 is a perspective view showing how a recording sheet is inserted in and discharged from the image forming apparatus according to the embodiment of the disclosure.

The user who wishes to do a work that requires outputting image data or reading a source document takes a seat where the image forming apparatus 1 is installed. In the example shown in FIG. 3, the user can take a seat on a chair 400, to do a work with the PC 300 placed on the top plate 20. When the user wishes to output image data generated or edited using the PC 300, the user transmits an image forming instruction to the image forming apparatus 1 that belongs to the seat where the user is seated, through wireless LAN. After the authentication and charging process to be subsequently described, the recording sheet P on which the image based on the image data designated by the transmitted image forming instruction has been formed is discharged obliquely upward from the recording sheet outlet 43, guided by the discharge guide member 41, as shown in FIG. 4. Since the recording sheet P is discharged obliquely upward, the user can remain seated on the chair 400 when picking up the recording sheet P. Here, the operation control unit 102 continuously or intermittently turns on the light emitter 32 located in the left end portion of the top face 30 of the top plate 20, immediately before the recording sheet P is discharged from the recording sheet outlet 43. Thus, the user can be notified that the recording sheet P is being discharged from the recording sheet outlet 43.

In contrast, in the case where an exclusive space is provided in a coffee shop or fast food shop and an image forming apparatus is installed in the exclusive space, the user has to move from his/her seat to the exclusive space where the image forming apparatus is installed, to pick up the outputted recording sheet. Therefore, the notebook computer or the tablet terminal placed on the table may be stolen, or the screen of the notebook computer or the tablet terminal may be spied, while the user is away for retrieving the recording sheet. In addition, the recording sheet outputted from the image forming apparatus may be stolen. Since the coffee shops and fast food shops are accessible by general public, information that the user is handling may leak to an unspecified person as stated above. Under such situation, the user is unable to utilize the image forming apparatus without worry, despite the image forming apparatus being available in the shop.

With the image forming apparatus 1 according to the embodiment of the disclosure, however, the user can remain seated on the chair 400 while working with the PC 300 and picking up the recording sheet P on which the generated or edited image data has been printed. Accordingly, the information handed by the user is barely likely to leak, and therefore the user can utilize the image forming means without worry.

To read a source document, the user transmits an image reading instruction to the image forming apparatus 1 that belongs to the seat where the user is seated, through the wireless LAN. After the authentication and charging process to be subsequently described, the user inserts the source document to the document inlet 44. At this point, since the outer end portion of the insertion guide member 42 opposite to the document inlet 44 can be visually recognized in a view from above, the user can easily identify the insertion position of the source document. In addition, since the insertion guide member 42 is inclined toward the top face 30 in the outward direction, the user can easily insert the source document while remaining seated on the chair 400. Here, after the reception unit 101 of the image forming apparatus 1 receives the image reading instruction, and the authentication and charging are done, the operation control unit 102 continuously or intermittently turns on the light emitter 33 located in the right end portion of the top face 30 of the top plate 20. Thus, the user can be notified that the document inlet 44 is ready to accept the insertion of the source document.

As described above, in the image reading job also, the user can complete the work while remaining seated on the chair 400, as in the image forming job. Accordingly, the information handled by the user is barely likely to leak, and therefore the user can utilize the image reading means without worry.

Figure 5A:
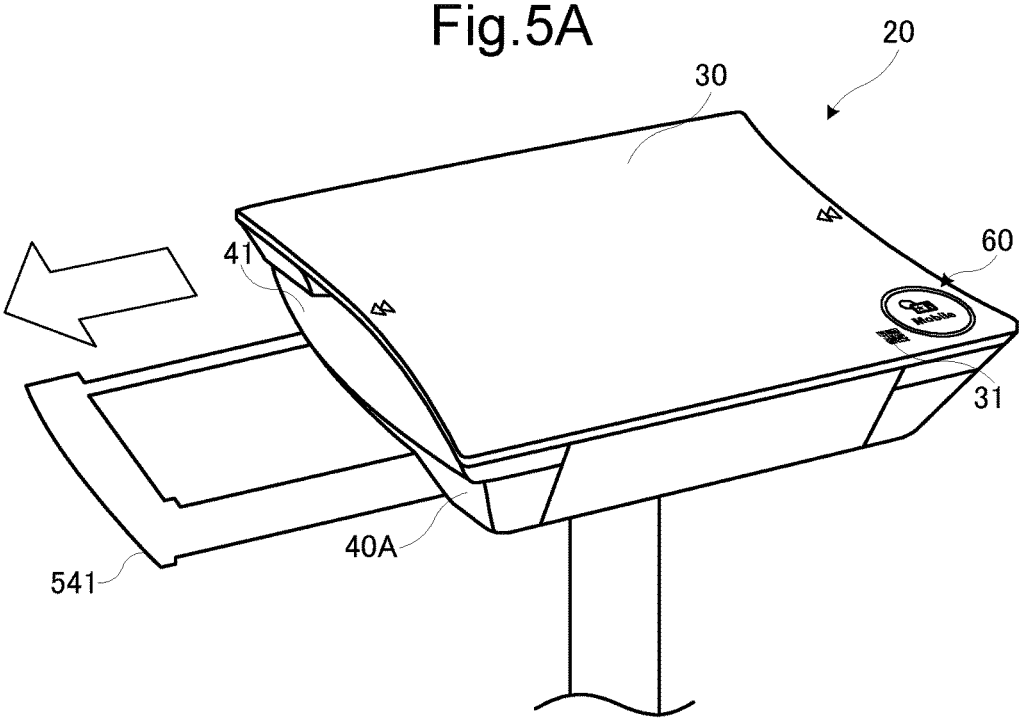
FIG. 5A is a perspective view for explaining how to refill the recording sheets in a paper feed cassette of the image forming apparatus according to the embodiment of the disclosure.

FIG. 5A is a perspective view for explaining how to refill the recording sheets in the paper feed cassette 541. As shown in FIG. 5A, the paper feed cassette 541 is drawably provided in the side face 40A of the top plate 20. Usually, the paper feed cassette 541 is locked with a non-illustrated lock mechanism, so as to be restricted from being drawn out from the side face 40A.

To refill the recording sheets, a service staff brings a staff card closely opposite the reading unit 62 of the card reader 60, so that the reading unit 62 reads the identification information stored in the staff card. Here, the staff identification information is stored in advance in the storage unit 212 of the management server 200. The authentication unit 104 causes the communication control unit 103 to receive the staff identification information stored in the storage unit 212, from the management server 200. Then the authentication unit 104 decides whether the received staff identification information agrees with the identification information read by the reading unit 62. In the case where the staff identification information agrees with the identification information read by the reading unit 62, the operation control unit 102 unlocks the lock mechanism, to thereby allow the paper feed cassette 541 to be drawn out from the side face 40A.

Figure 5B:
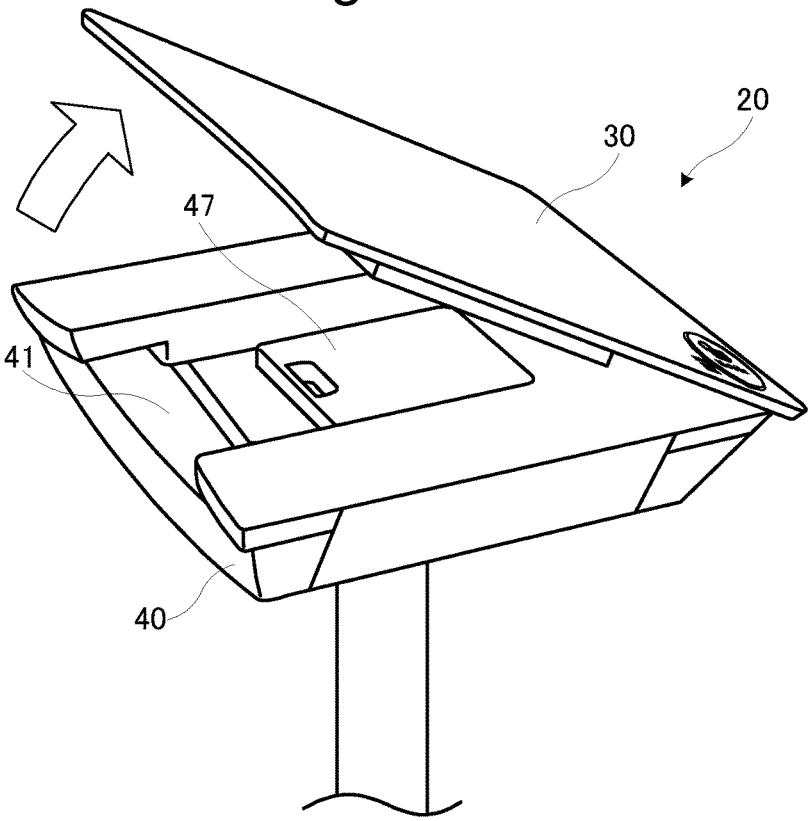
FIG. 5B is a perspective view for explaining how to refill toner in a toner container of the image forming apparatus according to the embodiment of the disclosure.

FIG. 5B is a perspective view for explaining how to refill the toner in a toner container 47. As shown in FIG. 5B, the top face 30 of the top plate 20 is openable. Upon opening the top face 30, the toner container 47 is exposed so as to be removed from inside the top plate 20. Usually, the top face 30 of the top plate 20 is locked with a non-illustrated lock mechanism, so as to be restricted from being opened.

To refill the toner, the service staff brings the staff card closely opposite the reading unit 62 of the card reader 60, as in the case of refilling the recording sheets. The authentication unit 104 performs the user authentication, and in the case where the staff identification information agrees with the identification information read by the reading unit 62, the operation control unit 102 unlocks the lock mechanism to thereby allow the top face 30 of the top plate 20 to be opened.

The refilling of the recording sheets or toner is an indispensable job for the image forming apparatus. In the case of the image forming apparatus installed in a general situation, a part of the casing can be opened or drawn out to refill the recording sheets or toner, by any person who wishes to do it. However, in the case of the image forming apparatus installed in a facility accessible by general public, such as a coffee shop or fast food shop, it is desirable that only specific persons such as the service staff are authorized to refill the recording sheets or toner. From such a viewpoint, the image forming apparatus 1 according to the embodiment of the disclosure is advantageous, because of the function to limit the person(s) to refill the recording sheets or toner using the reading unit 62 in association with the charging process to be subsequently described.

Figure 6:
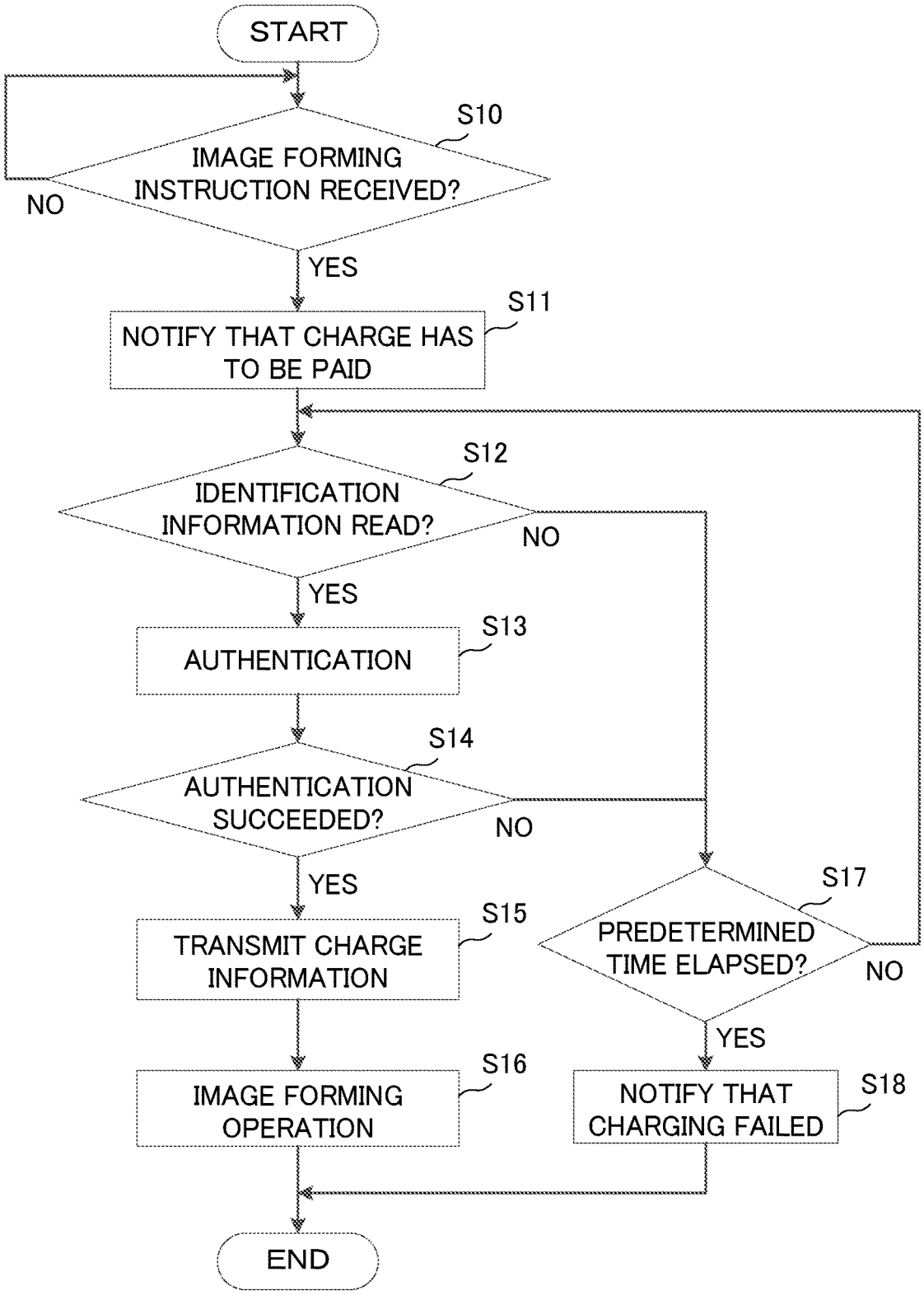
FIG. 6 is a flowchart showing an operation flow of the image forming apparatus according to the embodiment of the disclosure.

The flow of a specific operation of the image forming apparatus 1 will now be described hereunder. FIG. 6 is a flowchart showing the operation flow of the image forming apparatus 1.

When the reception unit 101 of the image forming apparatus 1 receives an image forming instruction transmitted from the PC 300 (YES at step S10), the charge control unit 105 issues a notice to the effect that the charge has to be paid (step S11).

For example, the charge control unit 105 continuously or intermittently turns on the light emitter 61 of the card reader 60. In view of this, the user can be notified that the charge has to be paid by bringing the member card containing the NFC tag closely opposite the reading unit 62 of the card reader 60. Alternatively, the charge control unit 105 may cause the communication control unit 103 to transmit the charging information to the PC 300, which is the source of the image forming instruction. The charging information indicates a fee to be charged according to details of the image forming job, such as the number of recording sheets on which an image is formed. Upon receipt of the charging information, the PC 300 displays the fee to be charged according to the charging information, on a display unit. Thus, the user can recognize the sum necessary for the image forming job.

After the process of step S11, the authentication unit 104 decides whether the reading unit 62 of the card reader 60 has read the identification information (step S12).

When the identification information is successfully read (YES at step S12), the authentication unit 104 performs the user authentication (step S13). Specifically, the authentication unit 104 decides whether any of the identification information received from the management server 200 agrees with the identification information read by the reading unit 62.

When the user authentication is successfully performed because one of the identification information received from the management server 200 agrees with the identification information read by the reading unit 62 (YES at step S14), the charge control unit 105 causes the communication control unit 103 to transmit the charging information indicating the fee to be charged according to details of the image forming job, such as the number of recording sheets on which an image is formed, together with the identification information read by the reading unit 62, to the management server 200.

The control unit 210 of the management server 200 stores the charging information transmitted from the image forming apparatus 1 in the storage unit 212, in association with the identification information. Thus, the shop in which the image forming apparatus 1 is installed can charge the sum indicated by the charging information to the user identified by the identification information, upon looking up the information in the storage unit 212 of the management server 200.

After step S15, the operation control unit 102 executes the image forming operation, by causing the image forming unit 51 to form the image based on the image data designated by the image forming instruction, on the recording sheet (step S16).

In contrast, in the case where the reading of the identification information has failed (NO at step S12), the process of step S12 is repeatedly performed until a predetermined period of time elapses. In the case where the identification information has not been successfully read within the predetermined period of time (YES at step S17), the charge control unit 105 issues a notice to the effect that the charging of the fee has failed (step S18). Specifically, the charge control unit 105 activates the light emitter 61 of the card reader 60 in a different mode from the mode adopted at step S11 (continuously or intermittently turning on). For example, the charge control unit 105 may turn on the light emitter 61 of the card reader 60 in red color.

Likewise, in the case where the user authentication has failed NO at step S14) the process of step S14 is repeatedly performed until a predetermined period of time elapses. In the case where the user authentication has not been successfully performed within the predetermined period of time (YES at step S17), the charge control unit 105 issues the notice to the effect that the charging of the fee has failed (step S18).

Thus, the operation control unit 102 allows the image forming unit 51 to form the image based on the image data designated by the image forming instruction on the recording sheet, provided that the authentication unit 104 successfully performs the user authentication and the reception unit 101 receives the image forming instruction transmitted from the external device such as the PC 300 used by the authenticated user.

Although the flowchart cited above represents the case where the image forming apparatus 1 receives the image forming instruction, when the image forming apparatus 1 receives the image reading instruction also, basically the same operation is performed.

Hereunder, a variation of the image forming apparatus 1 will be described. The image forming apparatus 1 may be modified in various manners, without limitation to the foregoing embodiment.

Figure 7A:
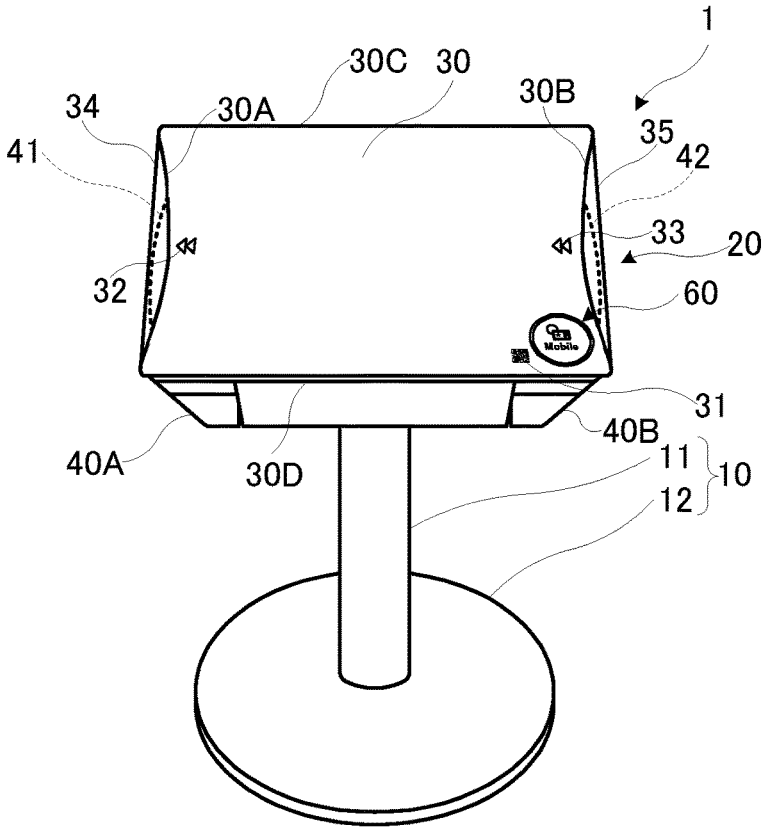
FIG. 7A and FIG. 7B are a perspective view and a top view respectively, showing an appearance of an image forming apparatus according to a variation.
Figure 7B:
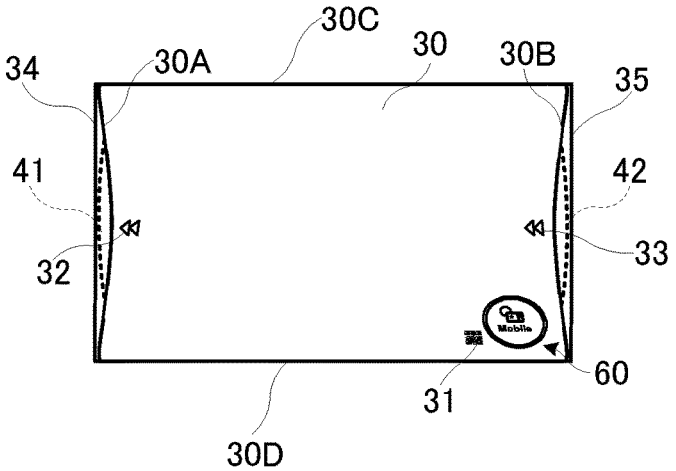

FIG. 7A and FIG. 7B illustrate an appearance of the image forming apparatus a according to the variation, FIG. 7A being a perspective view, and FIG. 7B being a top view. The image forming apparatus 1 according to the variation includes first eaves 34 provided on the top face 30 of the top plate 20, so as to cover the recording sheet outlet 43 (see FIG. 1C) and the discharge guide member 41 in a view from above. The image forming apparatus 1 according to the variation also includes second eaves 35 provided on the top face 30 of the top plate 20, so as to cover the document inlet 44 (see FIG. 1C) and the insertion guide member 42, in a view from above.

Since the image forming apparatus 1 is installed in a facility where a plurality of tables and chairs (seats) are provided, such as a coffee shop or fast food shop, drink and/or food are placed on the top face 30 of the top plate 20. Accordingly, when the drink spills or the fragments of the food are scattered, such foreign matters may intrude in the recording sheet outlet 43 or document inlet 44. The intrusion of foreign matters in the recording sheet outlet 43 or document inlet 44 may provoke malfunction of the image forming apparatus 1.

However, the image forming apparatus 1 according to the variation includes the first eaves 34 and the second eaves 35, and therefore the recording sheet outlet 43 and the document inlet 44 are exempted from the intrusion of foreign matters, even when the drink spills or the fragments of the food are scattered.

Further, in the image forming apparatus 1 according to the variation, the first eaves 34 and the second eaves 35 are formed of a light-transmissive material. Accordingly, the discharge guide member 41 and the insertion guide member 42 can be seen through when viewed from above, which facilitates the user to visually recognize the insertion position of the source document and the discharge position of the recording sheet.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus including an image forming unit configured to form an image on a recording sheet, the image forming apparatus comprising:

a casing constituting an outer shell of the image forming apparatus, the casing being formed in a table shape including a top plate unit and a leg portion supporting the top plate unit, the top plate unit including a flat working surface, wherein the image forming unit is located inside the top plate unit, the top plate unit includes a recording sheet outlet from which the recording sheet having an image formed thereon is discharged, the working surface is provided on a top face of the top plate unit, the recording sheet outlet is located on a side face of the top plate unit, a discharge guide member having a flat plate shape and inclined toward the working surface in an outward direction from the side face of the top plate unit, is provided on the side face of the top plate unit, so as to guide the recording sheet discharged through the recording sheet outlet, a first eaves is provided on the top face of the top plate unit so as to cover the recording sheet outlet and the discharge guide member in a view from above, the top plate unit further includes an image reading unit configured to read an image, a document inlet is provided in the top plate unit so as to insert a document an image on which is to be read, and the document from which the image has been read by the image reading unit is discharged through the recording sheet outlet.

2. The image forming apparatus according to claim 1, wherein the top plate unit further includes a toner container, the top face of the top plate unit is openable, and the toner container is exposed when the top face is opened, so as to be removed from inside the top plate unit.

3. The image forming apparatus according to claim 1, wherein the working surface is provided on the top face of the top plate unit, the document inlet is located on a side face of the top plate unit, and an insertion guide member having a flat plate shape and inclined toward the working surface in an outward direction from the side face of the top plate unit, is provided on the side face of the top plate unit, so as to guide the document to the document inlet.

4. The image forming apparatus according to claim 3, further comprising second eaves provided on the top face of the top plate unit so as to cover the document inlet and the insertion guide member in a view from above.

5. The image forming apparatus according to claim 4, wherein the second eaves is formed of a light-transmissive material, and the insertion guide member can be visually recognized in a view from above.

6. The image forming apparatus according to claim 1, wherein the top plate unit includes a first light emitter located in an end portion of the top face on a side of the document inlet, the top plate unit includes a second light emitter located in an end portion of the top face on a side of the recording sheet outlet, the image forming apparatus further comprising:

a control unit configured to control a light emitting operation of the first light emitter and the second light emitter; and a reception unit configured to receive an instruction of a user, wherein the control unit continuously or intermittently turns on the first light emitter when the reception unit receives an image reading instruction, and continuously or intermittently turns on the second light emitter when the recording sheet is discharged through the recording sheet outlet.

7. The image forming apparatus according to claim 1, further comprising:

a reading unit provided on the top face of the top plate unit and configured to read identification information proper to a user, from an object to be read brought close to the reading unit;

an authentication unit configured to perform user authentication with the identification information read by the reading unit;

a communication unit configured to perform transmission and reception of data to and from an external device;

a reception unit configured to receive the data transmitted from the external device; and a control unit configured to allow the image forming unit to form the image based on an image data designated by an image forming instruction on the recording sheet, when the authentication unit successfully performs the user authentication and the reception unit receives the image forming instruction transmitted from the external device used by an authenticated user.

8. The image forming apparatus according to claim 7, wherein the control unit is configured to cause, when the image forming unit forms an image on the recording sheet, the communication unit to transmit, to an external server, charging information according to a number of recording sheets on which the image is formed, together with the identification information.

9. The image forming apparatus according to claim 7, wherein the top plate unit further includes a toner container, the top face of the top plate unit is openable, and the toner container is exposed when the top face is opened, so as to be removed from inside the top plate unit, the image forming apparatus further comprising a lock mechanism that locks the opening action of the top face of the top plate unit, wherein the authentication unit is configured to decide whether any of predetermined administrator identification information agrees with the identification information read by the reading unit, and the control unit is configured to unlock the lock mechanism engaged with the top face of the top plate unit, when the authentication unit decides that the administrator identification information agrees with the identification information read by the reading unit.

10. An image forming apparatus including an image forming unit configured to form an image on a recording sheet, the image forming apparatus comprising:

a casing constituting an outer shell of the image forming apparatus, the casing being formed in a table shape including a top plate unit and a leg portion supporting the top plate unit, the top plate unit including a flat working surface, wherein the image forming unit is located inside the top plate unit, and the top plate unit includes a recording sheet outlet from which the recording sheet having an image formed thereon is discharged, the top plate unit further includes an image reading unit configured to read an image, a document inlet is provided in the top plate unit so as to insert a document an image on which is to be read, the document from which the image has been read by the image reading unit is discharged through the recording sheet outlet, the working surface is provided on the top face of the top plate unit, the document inlet is located on a side face of the top plate unit, an insertion guide member having a flat plate shape and inclined toward the working surface in an outward direction from the side face of the top plate unit, is provided on the side face of the top plate unit, so as to guide the document to the document inlet, and eaves is provided on the top face of the top plate unit so as to cover the document inlet and the insertion guide member in a view from above.

11. The image forming apparatus according to claim 10, wherein the eaves is formed of a light-transmissive material, and the insertion guide member can be visually recognized in a view from above.

12. The image forming apparatus according to claim 10, wherein the top plate unit further includes a toner container, the top face of the top plate unit is openable, and the toner container is exposed when the top face is opened, so as to be removed from inside the top plate unit.

13. The image forming apparatus according to claim 10, further comprising:

a reading unit provided on the top face of the top plate unit and configured to read identification information proper to a user, from an object to be read brought close to the reading unit;

an authentication unit configured to perform user authentication with the identification information read by the reading unit;

a communication unit configured to perform transmission and reception of data to and from an external device;

a reception unit configured to receive the data transmitted from the external device; and a control unit configured to allow the image forming unit to form the image based on an image data designated by an image forming instruction on the recording sheet, when the authentication unit successfully performs the user authentication and the reception unit receives the image forming instruction transmitted from the external device used by an authenticated user.

* * * * *